US008877699B2

(12) United States Patent
Preuschen et al.

(10) Patent No.: US 8,877,699 B2
(45) Date of Patent: Nov. 4, 2014

(54) DISHWASHER DETERGENT COMPRISING A LIQUID NON-IONIC SURFACTANT AND AT LEAST TWO SOLID NON-IONIC SURFACTANTS

(75) Inventors: Judith Preuschen, Ludwigshafen (DE); Andrea Stein, Ludwigshafen (DE)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 18 days.

(21) Appl. No.: 13/378,694

(22) PCT Filed: Jun. 29, 2010

(86) PCT No.: PCT/GB2010/051067

§ 371 (c)(1),
(2), (4) Date: Jan. 27, 2012

(87) PCT Pub. No.: WO2011/001170

PCT Pub. Date: Jan. 6, 2011

(65) Prior Publication Data

US 2012/0125374 A1 May 24, 2012

(30) Foreign Application Priority Data

Jul. 2, 2009 (GB) ..... 0911428.1

(51) Int. Cl.
*C11D 1/72* (2006.01)
*C11D 3/37* (2006.01)
*C11D 1/825* (2006.01)

(52) U.S. Cl.
CPC ..... *C11D 3/3719* (2013.01); *C11D 1/825* (2013.01)
USPC ..... 510/223; 510/220; 510/221; 510/224; 510/229; 510/230; 510/398; 510/421; 510/477; 510/533

(58) Field of Classification Search
USPC ..... 510/220, 221, 223, 224, 229, 230, 398, 510/421, 477, 533
See application file for complete search history.

(56) References Cited

U.S. PATENT DOCUMENTS

| | | | | |
|---|---|---|---|---|
| 5,457,176 | A | 10/1995 | Adler et al. | |
| 5,756,447 | A | 5/1998 | Hall | |
| 5,972,040 | A * | 10/1999 | Moss et al. | 8/137 |
| 6,034,044 | A * | 3/2000 | Scheper et al. | 510/220 |
| 6,048,368 | A * | 4/2000 | Tcheou et al. | 8/137 |
| 6,413,929 | B1 * | 7/2002 | Wehlage et al. | 510/500 |
| 7,429,273 | B2 * | 9/2008 | De Dominicis et al. | 8/137 |
| 2005/0250661 | A1 * | 11/2005 | Bragulla | 510/189 |
| 2008/0015134 | A1 * | 1/2008 | Ahmed et al. | 510/234 |
| 2009/0075855 | A1 * | 3/2009 | Gibis et al. | 510/224 |
| 2009/0093391 | A1 * | 4/2009 | Klein et al. | 510/221 |

OTHER PUBLICATIONS

International Search Report for application PCT/GB2010/051067 dated Sep. 29, 2010.

* cited by examiner

*Primary Examiner* — Charles Boyer
(74) *Attorney, Agent, or Firm* — Norris McLaughlin & Marcus PA

(57) ABSTRACT

A dishwasher detergent composition comprising:
a compound of formula 1;

Formula 1

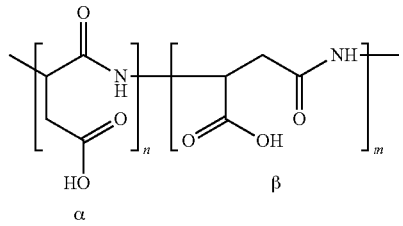

a liquid non-ionic surfactant; and
at least one solid non-ionic surfactant.

18 Claims, No Drawings

DISHWASHER DETERGENT COMPRISING A LIQUID NON-IONIC SURFACTANT AND AT LEAST TWO SOLID NON-IONIC SURFACTANTS

This is an application filed under 35 USC 371 of PCT/GB2010/051067.

This invention relates to detergent compositions for machine dishwashing comprising a combination of polyaspartic acid, a solid nonionic surfactant and a liquid nonionic surfactant.

In recent years there has been an ever increasing trend towards safer and environmentally friendly detergent compositions. This has led to development of alternative complexing agents (builders), which are used instead of predominantly phosphorous based builders. Phosphate builders can be connected with eutrophication issues.

On the other hand phosphates can bind calcium and magnesium ions, can act as alkalinity source for the detergent, they are used to buffer the wash liquor in a dishwasher at pH 9 and above together with other chemicals such as disilicate, metasilicates and soda. Phosphates are also able to disperse existing calcium carbonate in the wash liquor to prevent spotting on glasses.

Thus, replacing phosphates in a detergent means to compensate at least four different functions in an alkaline detergent. (1) Providing alkalinity; (2) buffering capacity, (3) complexing of magnesium and calcium ions; and (4) dispersing capacity of calcium carbonate.

To overcome this problem of finding an alternative to sodium tripolyphosphate (STPP), organic molecules such as citrate have been identified. Citrate has the advantage that it is biodegradable and is widely available. It is a crystalline material that can be easily purified. The disadvantage is the washing performance that is rather low compared to phosphates.

Biodegradable polymers such as polyaspartic acid (PAS) can support the weak builder such as citrate in a detergent composition to reduce the limescale formation. To further improve the performance the PAS can be modified.

U.S. Pat. No. 5,457,176 describes the manufacture of various PAS products, and their incorporation into detergent compositions.

U.S. Pat. No. 6,933,269 describes the modification of PAS by amidation of the carboxyl groups, and the use of such products in fabric detergent compositions.

Another aim of this invention is to formulate a hazard-label free detergent formulation without chemicals that are non-biodegradable such as phosphates, phosphonates or corrosion inhibitors.

The proposed technical solution is based on the main ingredients citrate and polyaspartic acid in combination with a bleach system, a surfactant system and a standard enzymatic system for a detergent.

Accordingly, there is provided according to a first aspect of the present invention a dishwasher detergent composition comprising:

a compound of Formula 1;

Formula 1

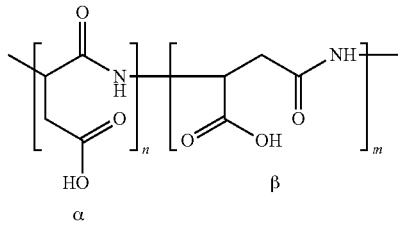

a liquid non-ionic surfactant; and at least one solid non-ionic surfactant.

Preferably the at least one solid nonionic surfactant has a melting point of at least 35° C.

Preferably the composition according to the first aspect of the present invention comprises from 5 to 50 wt % of the compound of Formula 1, more preferably 10 to 40 wt %, especially 20 to 35 wt %.

Preferably the composition according to the first aspect of the present invention is one wherein the compound of Formula 1 has a MW of at least 5,000, preferably at least 10,000, more preferably at least 12,000, especially at least 15,000. In a particularly preferred embodiment, PAS of MW 18,000 is used.

Preferably the PAS is fully hydrolysed, but there may be a percentage of up to 20 wt % of unhydrolysed cyclo-anhydride units in addition to the ring-opened units α and β. The PAS contains as side products organic acids such as aspartic acid, fumaric acid and up to 10 wt % water. It can be a powder or in granular form.

The polyaspartic acid (PAS) is able to interact with the surfactant present in the wash liquor. The film of surfactant molecules covering the surface of the tableware and the dishwasher is believed to be stabilized by the PAS; this prevents the deposition of calcium carbonate on the surfaces. A second and unexpected beneficial effect is an increased "carry over" of surfactant from the main washing cycle into the rinse cycle due to the stabilized films of surfactant. This is important for multi-benefit detergents, because they are used without adding extra rinse aid into the reservoir provided in the dishwasher.

Surfactants are a key component of detergent compositions, and classes of surfactants are anionic, cationic, amphoteric and non-ionic.

Non-ionic surfactants are preferred for automatic dishwashing (ADW) since they are defined as low foaming surfactant. The standard non-ionic surfactant structure is based on a fatty alcohol with a carbon $C_8$ to $C_{20}$ chain, wherein the fatty alcohol has been ethoxylated or propoxylated. The degree of ethoxylation is described by the number of ethylene oxide units (EO), and the degree of propoxylation is described by the number of propylene oxide units (PO).

The length of the fatty alcohol and the degree of ethoxylation/propxylation determines if the surfactant structure has a melting point below room temperature or in other words if is a liquid or a solid at room temperature.

Surfactants may also comprise butylene oxide units (BO) as a result of butoxylation of the fatty alcohol. Preferably, this will be a mix with PO and EO units. The surfactant chain can be terminated with a butyl (Bu) moiety.

An essential feature of the present invention is the presence of both a liquid and a solid non-ionic surfactant. Preferably the solid nonionic surfactant is one with a mp of >35° C. Solid surfactants can be either a paste or a powder or a granule. For compression of a powder detergent solid surfactants are preferred to have a granular structure.

Preferably the composition according to the first aspect of the present invention comprises at least 0.5 wt % of the liquid non-ionic surfactant, preferably at least 0.75 wt %, more preferably at least 1.0 wt %.

Preferably the composition according to the first aspect of the present invention comprises no more than 10 wt % of the liquid non-ionic surfactant, preferably no more than 5 wt %, more preferably no more than 4 wt %.

Preferably the composition according to the first aspect of the present invention comprises at least 0.1 wt % of the solid non-ionic surfactant, preferably at least 0.25 wt %, more preferably at least 0.4 wt %.

Preferably the composition according to the first aspect of the present invention comprises no more than 10 wt % of the solid non-ionic surfactant, preferably no more than 5 wt %, more preferably no more than 4 wt %.

In a further embodiment of the first aspect of the present invention, it is particularly advantageous for the solid non-ionic surfactant to comprise a mixture of at least two solid nonionic surfactants.

Many technological processes require control of liquid spreading over solid surfaces. When a drop is placed on a surface, it can completely wet, partially wet, or not wet the surface. Wetting can be defined in terms of the contact angle θ of a liquid droplet on a particular surface, with a smaller contact angle signifying greater wetting; a contact angle of between 0° and 90° is defined as highly wettable, with 0° being defined as totally wettable.

By reducing the surface tension with surfactants, a non-wetting material for water can be made to become partially or completely wetting. Surfactants are absorbed onto the liquid-vapor, solid-liquid, and solid-vapor interfaces, which modify the wetting behavior of hydrophobic materials to reduce the free energy. When surfactants are absorbed onto a hydrophobic surface, the polar head groups face into the solution with the tail pointing outward. In more hydrophobic surfaces, surfactants may form a bilayer on the solid, causing it to become more hydrophilic. As the surfactants are absorbed, the solid-vapor surface tension increases and the edges of the drop become hydrophilic. As a result, the drop spreads.

This process is time dependent, and the dynamic drop radius can be characterized as the drop begins to spread. The contact angle changes are based on the following equation:

$$\cos\theta(t) = \cos\theta_0 + (\cos\theta_\infty - \cos\theta_0)\left(1 - e^{\frac{-t}{\tau}}\right)$$

$\theta_0$ is the initial contact angle $\theta_\infty$ is the final contact angle $\tau$ is the surfactant transfer time scale The wetting properties of a surfactant are key to its performance in detergent compositions for use in ADW, regulating the amount of spots left on surfaces as a result of drying of unevenly spread water droplets.

Preferably the composition according to the first aspect of the present invention is one wherein the liquid non-ionic surfactant has fast wetting properties on glass, plastic and metal surfaces such that at least 90% of the surface is wetted in less than 30 seconds.

Preferred solid nonionic surfactants are ethoxylated non-ionic surfactants prepared by the reaction of a mono-hydroxy alkanol or alkylphenol with 6 to 20 carbon atoms. Preferably the surfactants have at least 12 moles, particularly preferred at least 16 moles, and still more preferred at least 20 moles, such as at least 25 moles of ethylene oxide per mole of alcohol or alkylphenol.

Particularly preferred solid non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols which additionally comprise poly-oxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and poly-oxypropylene and block copolymers of polyoxyethylene and polyoxypropylene initiated with trimethylolpropane.

Another preferred class of nonionic surfactant can be described by the formula:

$$R_1O[CH_2CH(CH_3)O]_x[CH_2CH_2O]_y[CH_2CH(OH)R_2]$$

where R1 represents a linear or branched chain aliphatic hydrocarbon group with 4-18 carbon atoms or mixtures thereof, R2 represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R_1O[CH_2CH(R_3)O]_x[CH_2]_kCH(OH)[CH_2]_jOR_2$$

where $R_1$ and $R_2$ represent linear or branched chain, saturated or unsaturated, aliphatic or aromatic hydrocarbon groups with 1-30 carbon atoms, $R_3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R_3$ in the formula above can be different. $R_1$ and $R_2$ are preferably linear or branched chain, saturated or unsaturated, aliphatic or aromatic hydrocarbon groups with 6-22 carbon atoms, where group with 8 to 18 carbon atoms are particularly preferred. For the group $R_3$=H, methyl or ethyl are particularly preferred. Particularly preferred values for x are comprised between 1 and 20, preferably between 6 and 15.

As described above, in case x>2, each $R_3$ in the formula can be different. For instance, when x=3, the group $R_3$ could be chosen to build ethylene oxide ($R_3$=H) or propylene oxide ($R_3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R_1O[CH_2CH(R_3)O]_xCH_2CH(OH)CH_2OR_2$$

The use of mixtures of different nonionic surfactants is suitable in the context of the present invention for instance mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt. The total amount of surfactants typically included is in amounts of up to 15% wt, preferably of from 0.5% wt to 10% wt, such as 1% wt to 5% wt. The distinct regions may contain any proportion of the total amount of surfactants as desired.

In a particularly preferred embodiment of the present invention, the composition according to the first aspect of the present invention is one wherein the liquid non-ionic surfactant has the general formula $$R_1\text{-}[EO]_n\text{-}[PO]_m\text{-}[BO_p]\text{-}Bu_q$$

wherein:

$R_1$ is an alkyl group of between $C_8$ and $C_{20}$;
EO is ethylene oxide;
PO is propylene oxide;
BO is butylene oxide;
Bu is butylene
n and m are integers from 1 to 15;
p is an integer from 0 to 15; and
q is 0 or 1.

Examples of especially preferred nonionic surfactants are the Plurafac™, Lutensol™ and Pluronic™ range from BASF and Genapol™ series from Clariant.

Preferably, the composition according to the first aspect of the present invention further comprises a biodegradable builder selected from the group consisting of sodium citrate, sodium iminodisuccinate, sodium hydroxyiminodisuccinate, sodium methylglycine diacetic acid and glutamic diacetic acid sodium salt.

Preferably, the composition comprises from 5 wt % to 60 wt % of a biodegradable builder, more preferably from 25 wt % to 50 wt %, especially from 35 wt % to 45 wt %.

Preferably the composition as hereinbefore described comprises no more than 5 wt % of a polyacrylate polymer.

Preferably the composition as hereinbefore described comprises no more than 25 wt % of sodium tripolyphosphate (STPP).

Optionally, the composition may comprise one or more enzymes. Desirably the enzyme is present in the compositions in an amount of from 0.01 to 3 wt %, especially 0.01 to 2 wt %, for each type of enzyme when added as a commercial preparation. As they are not 100% active preparations this represents an equivalent amount of 0.005 to 1 wt % of pure enzyme, preferably 0.01 to 0.75 wt %, especially 0.01 to 0.5% wt of each enzyme used in the compositions. The total amount of enzyme in the detergent composition is preferably in the range of from 0.01 to 6 wt %, especially 0.01 to 3 wt %, which represents an equivalent amount of 0.01 to 2 wt % of pure enzyme, preferably 0.02 to 1.5 wt %, especially 0.02 to 1% wt of total active enzyme used in the compositions.

Any type of enzyme conventionally used in detergent compositions may be used according to the present invention. It is preferred that the enzyme is selected from proteases, lipases, amylases, cellulases, laccases and all oxidases, with proteases and amylases, especially proteases being most preferred. It is most preferred that protease and/or amylase enzymes are included in the compositions according to the invention; such enzymes are especially effective for example in dishwashing detergent compositions. Any suitable species of these enzymes may be used as desired.

Preferably the composition further comprises one or more bleach components. Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potas-sium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono or diper-oxyphthalic acid, 2-octyldiperoxysuccinic acid, diperoxy-dodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 30 wt %, especially 5 to 25 wt %, most preferably 10 to 20% wt.

The composition may further preferably comprise one or more bleach activators. Any suitable bleach activator may be included for example TAED. Conventional amounts may be used e.g. in amounts of from 0.01 to 10 wt %, more preferred of from 0.1 to 8 wt % and most preferred of from 0.5 to 5 wt % based on the weight of the total composition.

The composition may further comprise fragrances or colours, preferably ones which are biodegradable and which do not require hazard labelling.

In one preferred embodiment of the first aspect of the present invention, the composition may further comprise one or more multivalent metal ions. It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Any suitable source of multivalent ions may be used, with the source preferably being chosen from sulphates, carbonates, acetates, gluconates and metal-protein compounds. Zinc salts are specially preferred glass corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Any conventional amount of the anti-corrosion agents may be included in the compositions of the invention. However, it is preferred that they are present in an total amount of from 0.01% wt to 5% wt, preferably 0.05% wt to 3% wt, more preferably 0.1 to 2.5% wt, such as 0.2% wt to 1% wt based on the total weight of the composition. If more than one anti-corrosion agent is used, the individual amounts may be within the preceding amounts given but the preferred total amounts still apply.

In a further embodiment of the first aspect of the present invention, all such anti-corrosion agents are omitted.

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allylsulphonic acid, methallylsulphonic acid, 2-hydroxy-3-(2-propenyloxy)propanesulphonic acid, 2-methyl-2-propenen-1-sulphonic acid, styrenesulphonic acid, vinylsulphonic acid, 3-sulphopropyl acrylate, 3-sulphopropylmethacrylate, sulphomethylacrylamide, sulphomethyl-methacrylamide and water soluble salts thereof. Suitable sulphonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %. The distinct regions may contain any proportion of the total amount of sulphonated polymer as desired.

The detergent composition according to the invention may also comprise one or more foam control agents. Suitable foam control agents for this purpose are all those conventionally used in this field, such as, for example, silicones and their derivatives, fatty acids and paraffin oil. The foam control agents are preferably present in the composition in amounts of 2% by weight or less of the total weight of the composition. The amount in each distinct region may be chosen as desired.

If any distinct region of the detergent composition is in the form of a shaped body or a tablet then a conventional amount of a binder material may be included in that region. Any conventional binders may be used, typically in an amount of up to 10% wt, more preferably in an amount of up to 8% wt in that distinct region. Suitable binders include polyethylene glycols.

The detergent compositions of the invention may also comprise minor, conventional amounts of perfumes, preservatives and/or colourants in any one or more of the distinct regions. Thickeners may also be used in paste and gel distinct regions. Any suitable thickeners may be used with gums, polymers and gels being preferred.

Such ingredients are typically present in amounts of up to 2% wt in the region in which they are used.

The compositions may also comprise chelating agents, such as for example TAED.

In a particularly preferred aspect the composition according to the first aspect of the present invention comprises:
5 to 50 wt % of a compound of formula 1;
at least 0.5 wt % of a liquid non-ionic surfactant; and
at least 0.1 wt % of at least one solid non-ionic surfactant.

In an especially preferred aspect the composition according to the first aspect of the present invention comprises:
15 to 40 wt % of a compound of formula 1;
0.5 to 10 wt % of a liquid non-ionic surfactant; and
0.1 to 10 wt % of at least one solid non-ionic surfactant.

In a further especially preferred aspect of the present invention, there is provided a composition which comprises:
20 to 35 wt % of a compound of formula 1;
0.5 to 2.5 wt % of a liquid non-ionic surfactant;
0.1 to 3.0 wt % of a combination of at least two solid non-ionic surfactants;
30 to 45 wt % of citric acid or a salt thereof;
10 to 20 wt % of a bleach; and,
0.5 to 2.5 wt % of an enzyme granule.

In a second aspect of the present invention, there is described a method of dishwashing using a composition substantially as hereinbefore described in the first aspect of the present invention.

In a third aspect of the present invention, there is described a composition substantially as hereinbefore described in the first aspect of the present invention which is in the form of a powder, a gel, a tablet, a PVOH rigid capsule with more than one compartment, or a PVOH film blister filled with solid or liquid composition.

In a fourth aspect of the present invention, there is described an automatic dispenser for use in a dishwasher containing one or more doses of a composition substantially as hereinbefore described in the first aspect of the present invention.

EXAMPLES

Formulations 1, 2 and 3: Automatic Dishwashing Tablet

| Component in wt % | 1 | 2 | 3 |
|---|---|---|---|
| Sodium carbonate | 8 | 8 | 8 |
| Sodium percarbonate | 11.0 | 11.0 | 11.0 |
| Trisodium citrate | 40 | 40 | 41.7 |
| TAED | 4.0 | 4.0 | 4.0 |
| Protease | 1.0 | 1.0 | 1.0 |
| Amylase | 0.5 | 0.5 | 0.5 |
| Zinc sulfate | 0.08 | 0.08 | 0.08 |
| Polyether ethoxylate, mp > 35° C., solid | 1.5 | 1.5 | 0.8 |
| Polyaspartic Acid Mw = 5000 g/mol | 25 | 0.0 | 0.0 |
| Polyaspartic Acid Mw = 15000 g/mol | 0.0 | 25 | 25 |
| Surfactant ($C_{12-15}$/$[EO]_8[PO]_4$), liquid | 2.0 | 2.0 | 1.0 |
| PEG 1500 | 4.92 | 4.92 | 4.92 |
| PEG 6000 | 1.5 | 1.5 | 1.5 |
| Surfactant ($C_{16}$/$[EO]_{25}$) mp > 35° C. solid | 0.5 | 0.5 | 0.5 |
| Total | 100.0 | 100.0 | 100.0 |
| pH measured 1 wt % in water | 9.8 | 9.8 | 9.8 |

Processing of the Powder:

20 g of the powder is mixed and compressed on a standard press Kilian SP 300 into a single phase tablet which then can be dosed out of the dosage chamber of a dishwasher.

Application Examples

The cleaning ability of the formulations was tested in a Miele 651 dishwashing machine using a 50° C. cycle Normal program following the IKW method. In each case a tablet with 20 g was added into the dosing chamber of the dishwasher. The water hardness was 21° GH. The results (given in Table 1) are expressed on a scale of 1 to 10 (1 being worst and 10 being best).

These results show that all three formulations based on citrate and PAS provide excellent cleaning results on tea stains at alkaline pH. To increase the performance of the bleach and the enzymes, the concentration of those components can be increased.

TABLE 1

Cleaning Performance

| | Formulation 1 | Formulation 2 | Formulation 3 |
|---|---|---|---|
| Bleachable Stain - Tea | 4.0 | 4.0 | 4.0 |
| Starch: dried-on oat flakes | 8.5 | 8.5 | 8.5 |
| Starch: dried-on starch mix | 7.2 | 7.2 | 7.2 |
| Protein: dried-on minced meat | 7.8 | 7.8 | 7.8 |
| Protein: dried-on egg yolk | 4.5 | 4.5 | 4.5 |
| Protein: dried-on egg/milk | 8.0 | 8.0 | 8.0 |
| Burnt-on milk | 6.2 | 6.2 | 6.2 |

The cleaning performance results show that all 3 formulations have the same performance profile. The changes of Molecular weight of the Polyaspartic acid and the changes of the surfactant system do not result in different cleaning performance.

The shine profile of the formulations was tested in a Bosch SGS058M02EU/36 dishwashing machine using a Eco 50° C.+Vario Speed (no 3 in 1 function) program following the Rinse Performance method. In each case a tablet with 20 g was added into the dosing chamber of the dishwasher. The water hardness was 21° GH. This test is repeated 5 times. Long drink glasses are evaluated.

The results of spotting and filming in a black box in Table 2 are expressed on a scale of 1 to 10 (1 being worst and 10 being best).

TABLE 2

Rinse Performance

| Long Drink Glasses | Formulation 1 | Formulation 2 | Formulation 3 |
|---|---|---|---|
| Spotting | 4.0 | 8.0 | 2.0 |
| Filming | 5.0 | 6.5 | 3.5 |

The rinse performance results show that all 3 formulations have a different performance profile. The increase of MW of the PAS results in less spotting on long drink glasses. The filming on long drink glasses is also significantly improved.

The surfactant system is a combination of liquid and solid surfactants. If every surfactant is reduced by half in the concentration heavy spotting occurs, and the filming on glasses increases tremendously.

The invention claimed is:

1. A dishwasher detergent composition comprising:

a compound of formula 1;

Formula 1

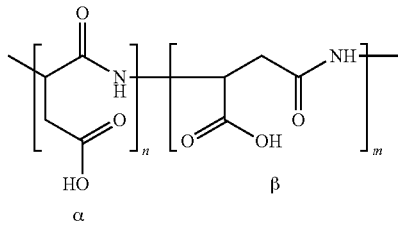

wherein the compound of formula 1 has a MW of at least 15,000, a liquid non-ionic surfactant; and at least two solid non-ionic surfactants, each having a melting point of >35° C.

2. A composition according to claim 1 comprising from 5 to 50 wt % of the compound of Formula 1.

3. A composition according to claim 1 comprising at least 0.5 wt % of the liquid non-ionic surfactant.

4. A composition according to claim 1 comprising no more than 10 wt % of the liquid non-ionic surfactant.

5. A composition according to claim 1 comprising at least 0.1 wt % of at least two solid non-ionic surfactants.

6. A composition according to claim 1 comprising no more than 10 wt % of at least two solid non-ionic surfactants.

7. A composition according to claim 1 which further comprises a biodegradable builder selected from the group consisting of sodium citrate, sodium iminodisuccinate, sodium hydroxyiminodisuccinate, sodium methylglycine diacetic acid and glutamic diacetic acid sodium salt.

8. A composition according to claim 7, wherein the biodegradable builder is sodium citrate.

9. A composition according to claim 1 wherein the liquid non-ionic surfactant has fast wetting properties on glass, plastic and metal surfaces such that at least 90% of the surface is wetted in less than 30 seconds.

10. A composition according to claim 1 wherein the liquid non-ionic surfactant has the general formula $$R_1\text{-}[EO]_n\text{-}[PO]_m\text{-}[BO]_p\text{-}Bu_q$$

wherein:

$R_1$ is an alkyl group of between $C_8$ and $C_{20}$;

EO is ethylene oxide;

PO is propylene oxide;

BO is butylene oxide;

Bu is butylene;

n and m are integers from 1 to 15;

p is an integer from 0 to 15; and, q is 0 or 1.

11. A composition according to claim 1 which comprises:

5 to 50 wt % of a compound of formula 1;

at least 0.5 wt % of a liquid non-ionic surfactant; and at least 0.1 wt % of at least two solid non-ionic surfactants.

12. A composition according to claim 11 which comprises:

15 to 40 wt % of a compound of formula 1;

0.5 to 10 wt % of a liquid non-ionic surfactant; and 0.1 to 10 wt % of at least two solid non-ionic surfactants.

13. A composition according to claim 12 which comprises:

20 to 35 wt % of a compound of formula 1;

0.5 to 2.5 wt % of a liquid non-ionic surfactant;

0.1 to 3.0 wt % of a combination of at least two solid non-ionic surfactants;

30 to 45 wt % of citric acid or a salt thereof;

10 to 20 wt % of a bleach; and, 0.5 to 2.5 wt % of an enzyme granule.

14. A composition according to claim 1 which comprises no more than 5 wt % of a polyacrylate polymer.

15. A composition according to claim 1 which comprises no more than 25 wt % of sodium tripolyphosphate (STPP).

16. A method of dishwashing the method comprising the steps of:

providing a composition according to claim 1 to an automatic dishwasher, and, operating the automatic dishwasher.

17. A composition according to claim 1 in the form of a powder, a gel, a tablet, a PVOH rigid capsule with more than one compartment, a PVOH film blister filled with solid or liquid composition.

18. An automatic dispenser adapted for use in a dishwasher containing one or more doses of a composition according to claim 1.

* * * * *